US009790791B2

(12) United States Patent
Gentile

(10) Patent No.: US 9,790,791 B2
(45) Date of Patent: Oct. 17, 2017

(54) EXTERNAL COMBUSTION ENGINE

(75) Inventor: Davide Gentile, Trieste (IT)

(73) Assignee: INNOVATIVE TECHNOLOGICAL SYSTEMS S.R.L., Gorizia (IT)

( * ) Notice: Subject to any disclaimer, the term of this patent is extended or adjusted under 35 U.S.C. 154(b) by 988 days.

(21) Appl. No.: 14/117,180

(22) PCT Filed: May 11, 2012

(86) PCT No.: PCT/IB2012/000912
§ 371 (c)(1),
(2), (4) Date: Jun. 23, 2014

(87) PCT Pub. No.: WO2013/050836
PCT Pub. Date: Apr. 11, 2013

(65) Prior Publication Data

US 2014/0290207 A1 Oct. 2, 2014

(30) Foreign Application Priority Data

May 11, 2011 (IT) ..... UD2011A0070

(51) Int. Cl.
*F01B 3/00* (2006.01)
*F02G 1/043* (2006.01)

(52) U.S. Cl.
CPC ..... *F01B 3/0079* (2013.01); *F02G 1/043* (2013.01); *F02G 2243/32* (2013.01); *F02G 2243/34* (2013.01)

(58) Field of Classification Search
CPC .... F01B 3/0079; F02G 1/043; F02G 2243/32; F02G 2243/34

(Continued)

(56) References Cited

U.S. PATENT DOCUMENTS 4,069,671 A 1/1978 Berntell
5,113,656 A * 5/1992 Swansen ..... F02B 75/16 60/517

(Continued)

FOREIGN PATENT DOCUMENTS

DE 202009011896 12/2009
EP 1126153 8/2001

(Continued)

OTHER PUBLICATIONS

International Search Report from International Application No. PCT/IB2012/000912 dated Sep. 13, 2012.

(Continued)

*Primary Examiner* — Hoang Nguyen
(74) *Attorney, Agent, or Firm* — Calfee Halter & Griswold LLP

(57) ABSTRACT

External combustion engine which comprises a first cylinder and a second cylinder, in which a first piston and a second piston are able to slide respectively. The first and second cylinder are fluidically connected with respect to each other for the passage of a heat-carrying fluid suitable to determine the cyclical movement of the first piston and the second piston. The external combustion engine also comprises a drive shaft rotating around an axis of rotation, and with which crank means are solidly associated, provided with at least a first pin and a second pin having pivoting axes parallel to each other, and also disposed distanced radially from the axis of rotation. The external combustion engine also comprises first and second kinematic connection means suitable to connect respectively the first pin and the second pin to the first piston and respectively to the second piston. The first pin and the second pin are disposed with the respective pivoting axes angularly offset so as to be angled (Continued)

by a desired angular amplitude equal to a first acute angle with respect to the axis of rotation.

12 Claims, 4 Drawing Sheets

(58) Field of Classification Search
USPC ..... 60/39.6, 517–526
See application file for complete search history.

(56) References Cited

U.S. PATENT DOCUMENTS

| | | | | |
|---|---|---|---|---|
| 5,678,406 | A * | 10/1997 | Ehrig | B64G 1/421 60/525 |
| 6,443,107 | B1 * | 9/2002 | Mendler | F02B 75/047 123/48 B |
| 7,055,470 | B2 * | 6/2006 | Kreuter | F01L 1/185 123/51 A |

FOREIGN PATENT DOCUMENTS

| | | |
|---|---|---|
| EP | 2314853 | 4/2011 |
| FR | 1219491 | 5/1960 |
| JP | S62190391 A | 8/1987 |
| WO | 9501505 | 1/1995 |
| WO | 9904153 | 1/1999 |
| WO | 2010070128 A2 | 6/2010 |
| WO | 2010070428 | 6/2010 |

OTHER PUBLICATIONS

Office Action from Japanese Application No. 2014-509851 dated Apr. 12, 2016.

* cited by examiner

EXTERNAL COMBUSTION ENGINE

CROSS-REFERENCE TO RELATED APPLICATION

This application is the U.S. national phase entry of PCT/IB2012/000912, with an international filing date of 11 May 2012, which claims the benefit of Italian Application Serial No. UD2011A000070, with a filing date of 11 May 2011, the entire disclosures of which are fully incorporated herein by reference.

FIELD OF THE INVENTION

The present invention concerns an external combustion engine, also known as a Stirling engine, which exploits a cycle of isothermal expansion and compression of a thermodynamic fluid, for example air, nitrogen, helium or other gases, to determine the alternate and cyclical movement of, a displacer and a piston so as to entail the rotation of a determinate drive shaft from which mechanical work is obtained.

BACKGROUND OF THE INVENTION

External combustion engines are known, also known as Stirling engines, which exploit a difference in temperature caused in a thermodynamic fluid and actuate the cyclical and alternate movement of a displacer and a piston.

In particular Stirling engines are known of the so-called gamma type, which comprise a first cylinder and a second cylinder disposed in quadrature with respect to each other, that is, with their respective axes angled by 90° to each other, and in which a first piston, also called displacer, and a second piston slide. The displacer and the second piston are connected by means of respective connecting rods near a single crank pin. The latter is keyed onto a drive shaft from which the mechanical work obtained is taken.

The first cylinder is provided with a hot part disposed near the head, or in other words, near the upper dead point of the displacer, and with a cold part disposed near the lower dead point of the displacer. The hot part and the cold part of the first cylinder are respectively heated and cooled to transfer heat to the thermodynamic fluid contained in the first cylinder.

The hot part and the cold part of the first cylinder are suitably connected fluidically with each other, for example by providing bleeding between the external jacket of the first cylinder and the displacer.

The first cylinder, near its cold part, is provided with a pipe connecting with the head of the second cylinder, so as to create a fluidic connection between the first and second cylinder.

By exploiting the expansion of the thermodynamic fluid due to the contribution of heat from the hot part, the second piston moves toward its lower dead point. The displacer moves toward the cold part, entailing a cooling of the previously heated thermodynamic fluid and therefore entailing a contraction of the fluid, which draws the second piston toward its upper dead point.

The alternate movement of the second piston from the upper dead point to the lower dead point causes the drive shaft to rotate and hence the mechanical work to be generated.

Although this type of engine is silent, has a low environmental impact and requires limited maintenance, it does not allow variations and modulations of the nominal power, and substantially functions always at the same capacity.

Due to this limitation, such engines are almost exclusively used in applications where a continuous and constant delivery of energy is required.

In order to increase the flexibility of this type of engine, the international patent application WO-A-2010/070428 is known, in the name of the present Applicant, which provides the possibility of varying the reciprocal angle between the first cylinder and the second cylinder in order to vary the cc volume of the engine and hence to vary the functioning modes or the rotation speed of the engine itself.

Although this solution allows to vary the rotation speed of the engine and hence to adapt it to functioning requirements almost instantaneously, as requested by the user, it is in any case more complex than a static engine, and also, in particular configurations, it may have a rather low functioning performance, which is more accentuated the more the first and second cylinder are distanced from their quadrature condition. The reduced efficiency is determined by the increase in idle volumes in the first and second cylinder, that is, fluid that expands/compresses and does not generate any useful work. In certain situations, this can lead to this type of engines with variable configuration being abandoned if the applications require a substantially constant supply of energy.

In fact, in order to satisfy certain requirements and requests, in particular for less complexity and a lower economic cost, it is necessary to achieve static engines, and therefore not with a variable configuration of the reciprocal angle between the first and second cylinder, which have a good performance and are not bulky.

On the contrary, the gamma type engine, given the disposition of the first and second cylinder, has a very bulky engine which in particular applications is not acceptable.

The same document WO-A-2010/070428 also describes a form of embodiment of the external combustion engine in which kinematic connection means, such as connecting rods and bars, are associated to the first and second piston, and respectively to crank means configured to rotate around an axis of rotation and move the first and second piston in an alternate motion.

The crank means comprise a first crank pin and a second crank pin disposed angularly offset with respect to each other and at the same distance from the axis of rotation, so as to achieve a travel of the first piston that is identical to that of the second piston.

This form of embodiment of the engine, in some particular applications, may be not very efficient from the thermodynamic point of view, given that the heat exchanges of the work fluid are not optimized in the first and second cylinder.

Indeed it is known that the mechanical work absorbed during the expansion and compression of a hot fluid, given the same variation in volume to which it is subjected, is always greater than the mechanical work absorbed during the expansion and compression of a colder fluid. In consideration of this, the engine described in the state of the art does not allow to optimize the relation between the heat exchanges in the hot and cold part, and the functioning kinematics of the engine.

Purpose of the present invention is to obtain an external combustion engine which is compact, simple to make, efficient and economical.

The Applicant has devised, tested and embodied the present invention to overcome the shortcomings of the state of the art and to obtain these and other purposes and advantages.

SUMMARY OF THE INVENTION

The present invention is set forth and characterized in the independent claim, while the dependent claims describe other characteristics of the invention or variants to the main inventive idea.

In accordance with the above purpose, an external combustion engine comprises:

- a first cylinder and a second cylinder, disposed angularly offset and in a fixed position with respect to each other, in which a first piston and a second piston are able to slide respectively, and in which the first and second cylinder are fluidically connected with each other for the passage of a heat-carrying fluid suitable to determine the cyclical movement of the first piston and the second piston;
- a drive shaft rotating around an axis of rotation, and with which crank means are solidly associated, said crank means being provided with at least a first pin and at least a second pin having pivoting axes parallel to each other, and also distanced radially from the axis of rotation; and
- first and second kinematic connection means suitable to connect respectively the first pin and the second pin to the first piston and respectively to the second piston so as to provide, together with the crank means, for the rotation of the drive shaft.

According to one feature of the present invention, the first pin and the second pin are disposed with the respective pivoting axes angularly offset so that the first pin and the second pin are angled by a desired angular amplitude equal to a first acute angle with respect to the axis of rotation.

Moreover, according to the present invention, the first pin is distanced radially by a first distance with respect to the axis of rotation, and the second pin is distanced radially by a second distance with respect to the axis of rotation, so as to determine a differentiated travel of the first piston with respect to that of the second piston.

In this way it is possible to optimize the efficiency of the thermodynamic cycle of the engine and in particular to optimize the exchanges of mechanical work of the second piston, to optimize the heat exchanges inside the first cylinder, releasing the thermodynamic functioning modes of the first piston with respect to the second. Indeed, given that the variation in volume is achieved by the second, working piston, and that the variation in the temperature of the working fluid is achieved by the first piston, or displacer, which imparts to the latter the movement toward the heat exchangers of the first cylinder, it is useful to differentiate the two kinematics in order to optimize the functioning of the engine, also with regard to the hot and cold part of the first cylinder.

Furthermore, the particular configuration of the angular offset of the first and second pin, and the differentiation of the travels of the pistons, allows to achieve a kinematic mechanism that is simple to make and in which unfavorable kinematic conditions are avoided, due for example to the dead points of the connecting rod-crank mechanisms.

According to another feature, the first radial distance of the first pin with respect to the axis of rotation is greater than the second radial distance of the second pin with respect to the axis of rotation. This causes a greater travel of the first piston inside the chamber than that of the second piston, thus allowing to have a greater quantity of working fluid participating in the heating/cooling inside the first cylinder, that is, it allows to increase the usable power obtainable from the thermodynamic cycle of the engine.

In particular, the first cylinder is provided with a hot chamber and a cold chamber between which the first piston is provided, which is made to slide in the first cylinder due to the effect of the expansion/compression of the heat-carrying fluid which is due to the heating/cooling of the hot and cold chamber.

According to a preferential form of embodiment, the first piston and the second piston are able to slide inside the first cylinder and the second cylinder respectively along a first axis and a second axis, which are disposed angled with respect to each other by a second acute angle.

It is advantageous to provide that the first angle has an amplitude comprised between 10° and 60°, advantageously between 15° and 50°, preferably between 20° and 40°, and that the second angle has an amplitude comprised between 10° and 60°, advantageously between 15° and 50°, preferably between 20° and 40°.

This particular conformation thus allows to reduce the overall transverse bulk compared with a gamma type Stirling engine and with cylinders disposed at 90° with respect to each other.

According to another form of embodiment, the sum of the amplitude of the first angle and the second angle is comprised between about 85° and 95°, for example advantageously about 90°. This particular configuration, also called quadrature phase, allows to optimize the cycles of expansion/compression that occur inside the cylinders, avoiding opposite reaction forces against the rotation forces of the drive shaft.

According to a particular advantageous form of embodiment, the crank means comprise at least two arms that extend radially with respect to the drive shaft with which a crank button is solidly associated, which comprises at least the first and the second pin. This form of embodiment is advantageous both from the constructional point of view and also with regard to the assembly of the kinematic connection means to the pins.

According to another form of embodiment, the crank button comprises two plate elements disposed adjacent and distanced from each other and between which the first pin is interposed, and two second pins are provided, each associated on the external face of the two plate elements, with which the second kinematic connection means of the second piston are connected.

According to another form of embodiment, it is provided that the first axis and the second axis of the first and second cylinder lie on a plane that is substantially orthogonal with respect to the axis of rotation of the drive shaft. This particular conformation allows a more uniform distribution of the inertial loads on the bearing structure of the engine, and also allows a further reduction in the bulk.

BRIEF DESCRIPTION OF THE DRAWINGS

These and other characteristics of the present invention will become apparent from the following description of a preferential form of embodiment, given as a non-restrictive example with reference to the attached drawings wherein.

Figure 1:
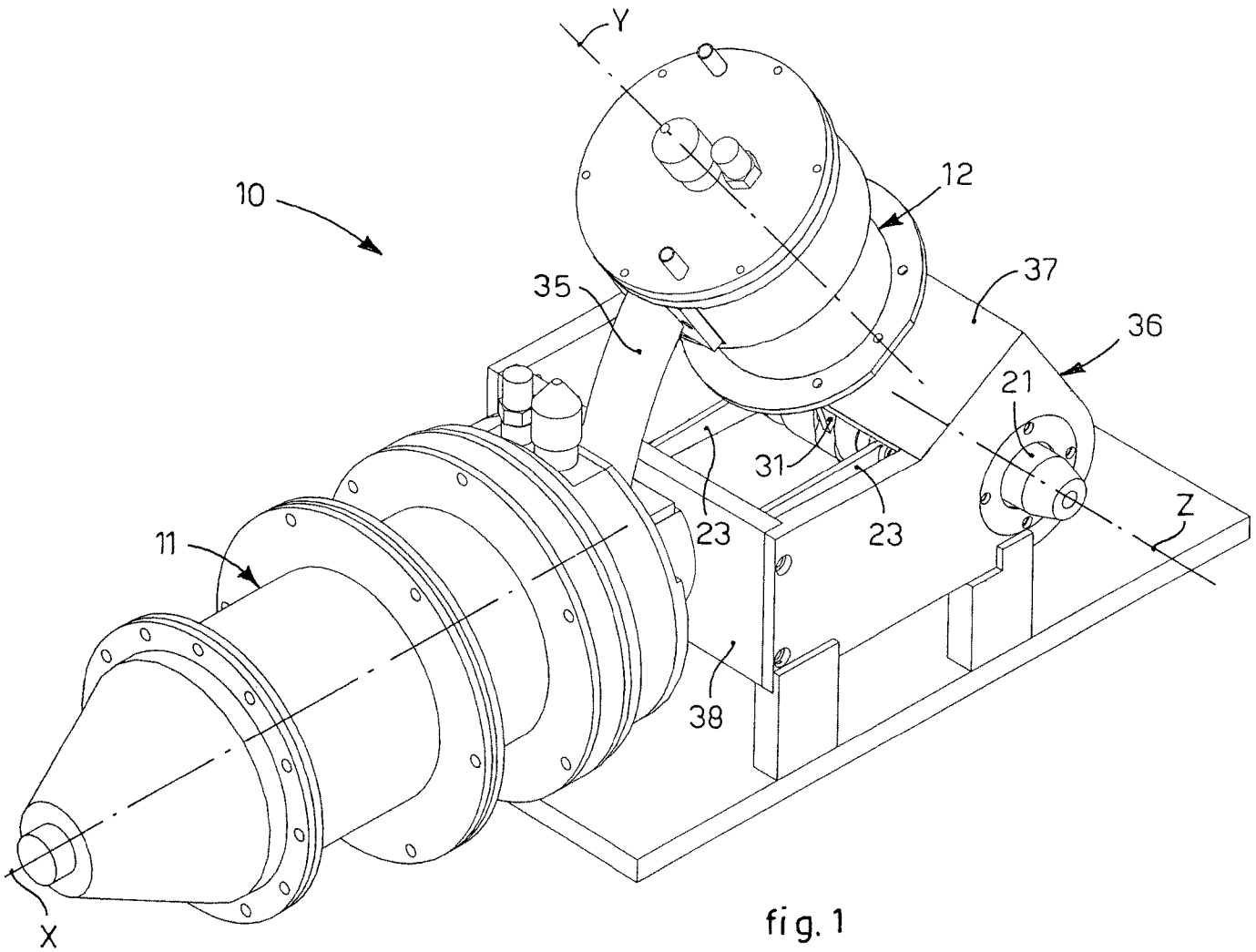
FIG. 1 is a perspective view of an external combustion engine according to the present invention.

To facilitate comprehension, the same reference numbers have been used, where possible, to identify identical common elements in the drawings. It is understood that elements and characteristics of one form of embodiment can conveniently be incorporated into other forms of embodiment without further clarifications.

DESCRIPTION OF SOME FORMS OF EMBODIMENT

Figure 2:
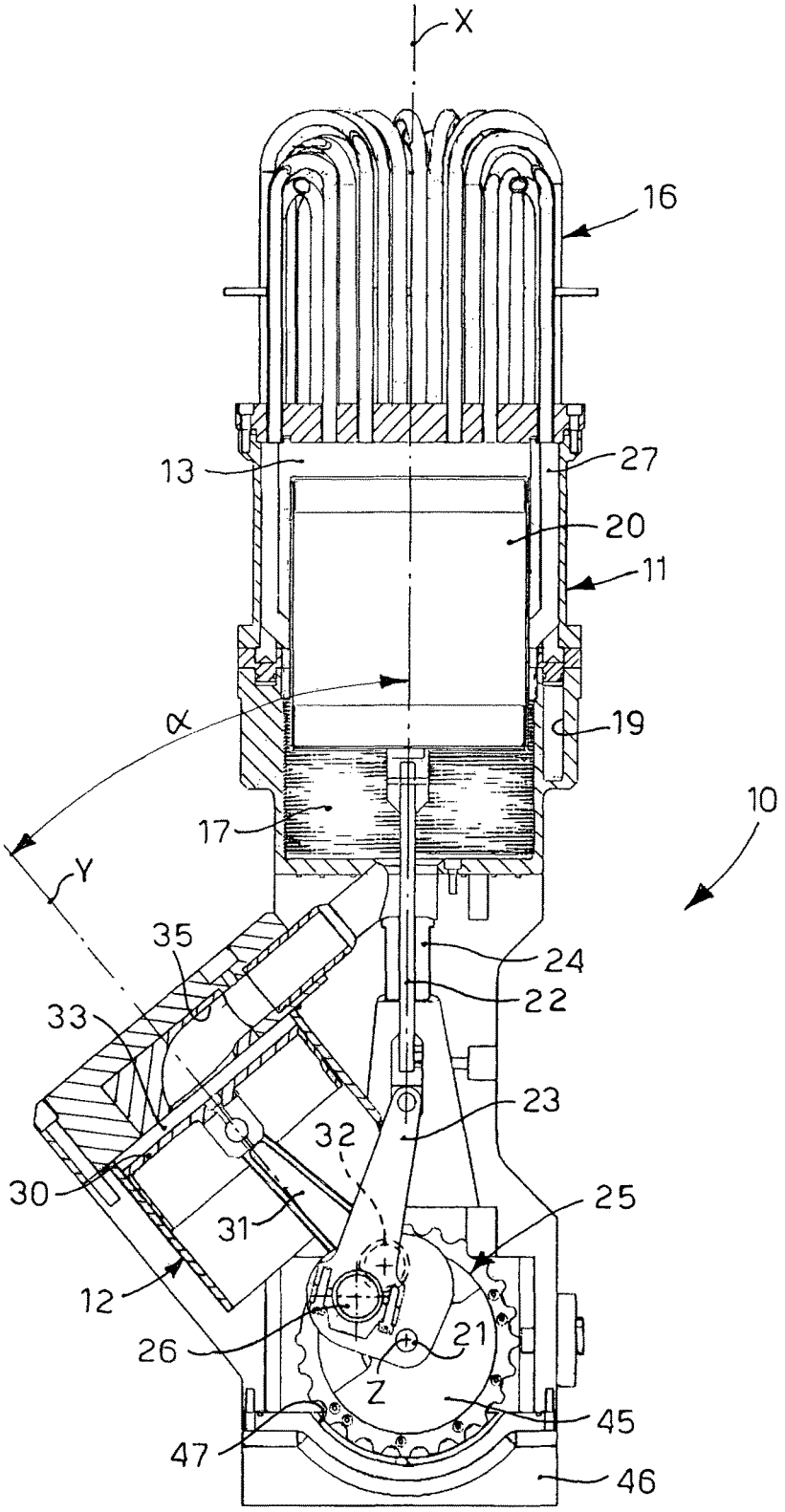
FIG. 2 is a section view of an external combustion engine according to a variant of FIG. 1.

With reference to the attached drawings, an external combustion engine, also called Stirling engine, is denoted in its entirety by the reference number 10, and comprises a first cylinder 11 and a second cylinder 12 that develop axially respectively along a first axis X and a second axis Y, disposed in a fixed position, angled with respect to each other by an angle α, in this case acute, and in particular in FIG. 2 with an amplitude equal to about 40°.

The first cylinder 11 comprises a first part, or hot chamber 13, near its head, which is suitably heated by heating means, in this case a heat exchanger 16 made of a bundle of tubes through which a heat-carrying fluid passes, and a cold part, or cold chamber 17 which is cooled through heat exchange with a cooling fluid which is made to flow in a cooling channel 19 made in the jacket of the first cylinder 11.

In other forms of embodiment (FIG. 1), the hot chamber 13 is heated by a direct flame on the outer part of the first cylinder 11 or by means of one or more heat concentrators, for example a lens, a panel or a mirror.

In the hot chamber 13 relatively high temperatures can be reached, for example about 400° C.-500° C.

The cold chamber 17 may also be cooled for example by providing finned batteries using natural or forced convection that cover the outer surface of the second cylinder 12, and relatively low temperatures may be reached in them, for example about 130° C.-140° C.

In order to increase the heat exchange surface of the cold chamber 17, it is possible to provide that its inner surface is provided with a plurality of cooling fins.

Inside the first cylinder 11 (FIG. 2), a first piston or displacer 20 is disposed, sliding along the first axis X, and is kinematically connected to a drive shaft 21 by means of a bar 22, a first connecting rod 23 and a crank 25.

Internally and peripherally to its jacket, the first cylinder 11 comprises a regenerator 27, for example made of porous metal material with high heat exchange capacities. The regenerator 27 therefore has efficient heat exchange properties and is sized to prevent high losses of load of the fluid.

Together with the regenerator 27, the first piston 20 fluidically separates the hot chamber 13 from the cold chamber 17.

In particular, the regenerator 27 prevents the hot chamber 13 and the cold chamber 17 from being fluidically short-circuited with respect to each other, allowing to obtain an excellent heat exchange between the hot fluid and the cold fluid. The drive shaft 21 is disposed rotating on bench pins, not visible in the drawings, around an axis of rotation Z. More specifically, it is advantageous to provide that the axis of rotation Z is disposed substantially orthogonal with respect to a plane on which the first axis X and the second axis Y lie. In fact, in this way it is possible to reduce the overall bulk of the engine and also to distribute more uniformly the inertial loads of the engine on the bench pins.

The bar 22 is constrained to slide axially along the first axis X by means of a block 24, fixed and solid with the casing of the engine, and is pivoted with one end to the displacer 20 and with the other end to the first connecting rod 23.

The first connecting rod 23 is in turn pivoted to the crank 25 near a first pin 26.

Inside the second cylinder 12, sliding along the second axis Y, a second piston 30 is disposed, and is connected, by means of two second connecting rods 31 disposed symmetrical to each other with respect to the axis Y, to the crank 25 near corresponding two second pins 32. The provision of two second connecting rods 31, instead of only one, allows to obtain an equal distribution of the flexional loads on the drive shaft 21, such as to increase the duration of the bench pins, not visible in the drawings, and on which the drive shaft 21 rotates.

The second piston 30 and the second cylinder 12 define a work chamber 33 inside which the thermodynamic fluid expands/compresses.

The work chamber 33 of the second cylinder 12 and the cold chamber 17 of the first cylinder 11 are fluidically interconnected by means of a connection pipe 35 through which the fluid present in the cold chamber 17 can pass due to the effect of the expansion/compression of the thermodynamic fluid.

More specifically, the connection pipe 35 is connected to the second cylinder 12 near the head of the latter, and to the first cylinder 11 near the lower dead point of the displacer 20.

Given the particular disposition of the first 11 and second cylinder 12, it is possible to considerably reduce the extension of the connection pipe 35, thus reducing losses of load and therefore increasing the efficiency of the engine.

Both the first 11 and the second cylinder 12 are mounted fixed on a single fixed support structure 36 comprising a first plate 37 and a second plate 38, to which the first 11 and the second cylinder 12 are respectively connected. The first 37 and the second plate 38 are disposed angled with respect to each other by an angle of amplitude substantially equal to the angle α between the two axes X and Y.

The crank 25 comprises two arms 42 that extend radially with respect to the drive shaft 21 to which they are directly connected, and on which respective holes 43 are made in order to key, between them, a crank button 40. On the side opposite where the holes 43 are made, the arms 42 are provided with counter-weights 45 which perform a flywheel function during the cyclical movement of the pistons.

The crank button 40 comprises the first 26 and the two second pins 32 with which the first connecting rod 23 and the second connecting rods 31 are respectively connected.

The crank button 40 is connected through coupling by interference, with its two second pins 32, to the arms 42 of the crank 25 near its holes 43.

The first pin 26 and the second pins 32 have respectively a first pivoting axis J and a second pivoting axis K, disposed substantially parallel with respect to each other and with respect to the axis of rotation Z of the drive shaft 21. During the rotation of the crank 25, the first pin 26 and the second pins 32 are made to rotate around the axis of rotation Z of the drive shaft 21.

In particular, the crank button 40 is provided with two plate elements 41, substantially triangular in shape, disposed adjacent and distanced with respect to each other and between which the first pin 26 is interposed. On the outer sides of the two plate elements 41, instead, the two second pins 32 are disposed.

It is advantageous to provide that the two plate elements 41, the first pin 21 and the second pins 33 are made in a single body.

When coupled to the arms 42, the crank button 40 disposes the first pivoting axis J of the first pin 21 and the second pivoting axis K of the second pins 22 distanced from the axis of rotation Z, respectively by a first distance B and a second distance R.

Figure 4:
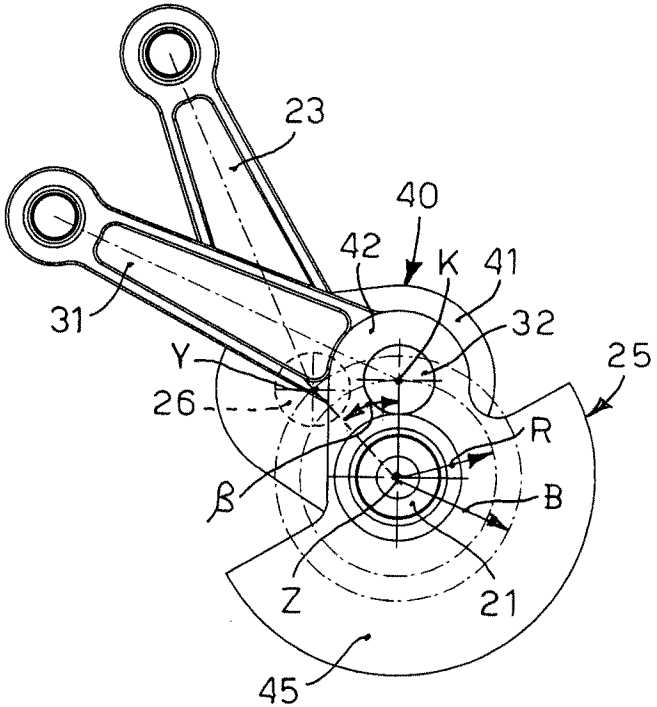
FIG. 4 is a detail of FIG. 2 in one operating condition.
Figure 3:
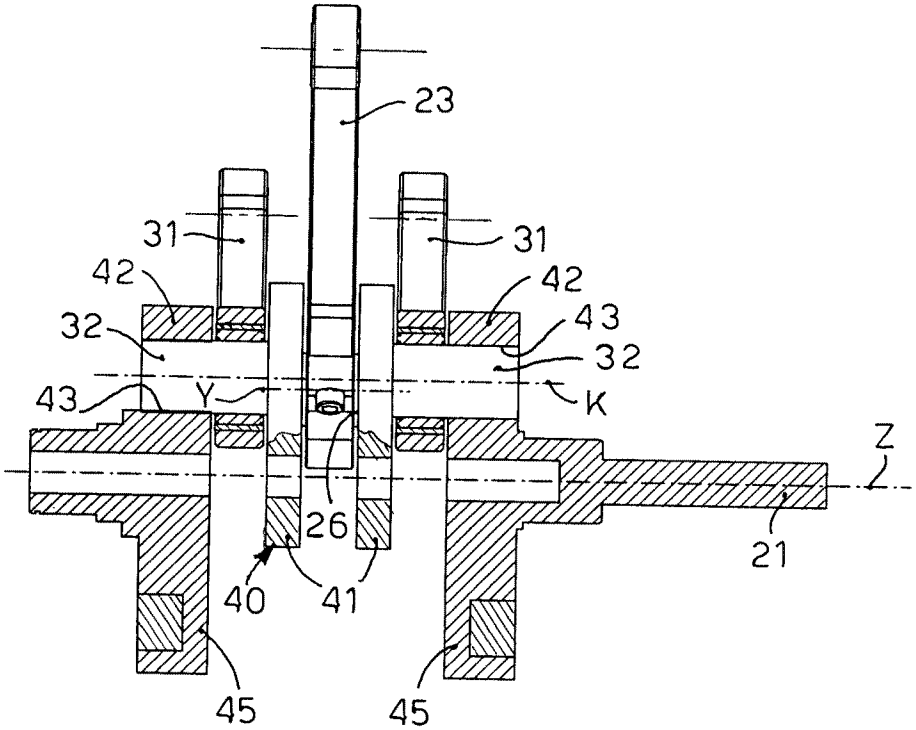
FIG. 3 is a section view of a detail of FIG. 2.
Figure 5:
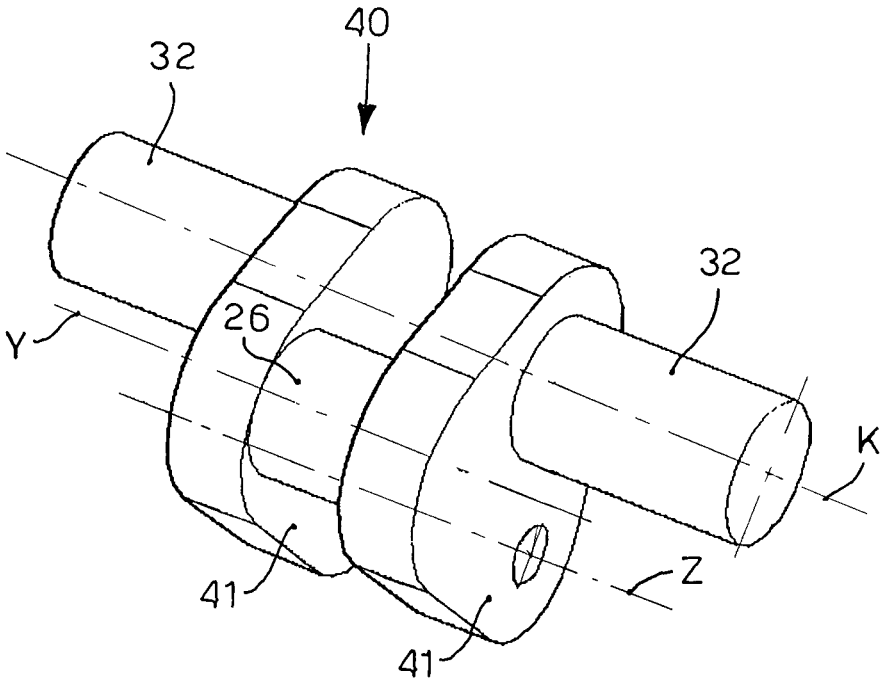
FIG. 5 is a perspective view of a detail of FIG. 4.

With reference to FIG. 4, the first distance B is greater than the second distance R. This form of embodiment allows to have a greater quantity of fluid participating in the expansion/compression, that is, heating/cooling, inside the first cylinder 11, and this entails an increase in the power obtainable from the thermodynamic cycle of the engine.

Furthermore, the first pin 26 and the second pins 32 are disposed angled with respect to each other and to the axis of rotation Z, by a second angle β.

The sum of the amplitude of angle α and the amplitude of angle β is equal to the phase angle between the displacer 20 and the second piston 30.

It is advantageous to provide that the phase angle is comprised between 85° and 95°, advantageously equal to 90°, that is, such that during the alternate movement of the pistons no peaks of pressure are generated, unfavorable to the rotational motion of the drive shaft 21.

With reference to FIG. 2, the crank 25, the crank button 40 and at least some of the connecting rods 23, 31 are contained inside a containing casing 46, and are suitably lubricated in a bath of oil, providing in a known manner an oil sump 47 on the bottom of the containing casing 46.

It is clear that modifications and/or additions of parts may be made to the external combustion engine as described heretofore, without departing from the field and scope of the present invention.

The invention claimed is:

1. An external combustion engine comprising:

a drive shaft rotating about an axis of rotation, a crank coupled to the drive shaft and having a first pin with a first pivoting axis and a second pin with a second pivoting axis, wherein the first pivoting axis and the second pivoting axis are substantially parallel to each other, the first pin is radially distanced from the axis of rotation by a first distance, the second pin is radially distanced from the axis of rotation by a second distance, and the first distance and second distance are unequal, a first cylinder having a first piston, a first connecting rod connecting the first pin to the first piston, a second cylinder having a second piston, and a second connecting rod connecting the second pin to the second piston, wherein the first cylinder and the second cylinder are offset angularly from each other and in fluid communication with each other.

2. The external combustion engine as in claim 1, wherein the first distance is greater than the second distance.

3. The external combustion engine as in claim 1, wherein a first angle is formed by the intersection of a plane formed by the first pivoting axis and the axis of rotation and a plane formed by the second pivoting axis and the axis of rotation, the first piston slides in the first cylinder along a first stroke axis, the second piston slides in the second cylinder along a second stroke axis, a second angle is formed by the first and second stroke axes, the first angle is between about 10° and about 60°.

4. The external combustion engine as in claim 3, wherein the first angle is between about 15° and about 50°.

5. The external combustion engine as in claim 4, wherein the first angle is between about 20° and about 40°.

6. The external combustion engine as in claim 3, wherein the second angle is between about 10° and about 60°.

7. The external combustion engine as in claim 6, wherein the second angle is between about 15° and about 50°.

8. The external combustion engine as in claim 7, wherein the second angle is between about 20° and about 40°.

9. The external combustion engine as in claim 3, wherein the sum of the first angle and the second angle is between about 85° and about 95°.

10. The external combustion engine as in claim 1, wherein further comprising a crank button housing the first and second pins, wherein the crank button is configured to couple with the drive shaft and the crank further comprises at least two arms radially extending with respect to the drive shaft.

11. The external combustion engine as in claim 10, wherein the crank button further comprises two plate elements disposed adjacent and distanced from each other with the first pin is interposed between, and two second pins are respectively disposed on the external face of each plate elements.

12. The external combustion engine as in claim 1, wherein the first and second stroke axes of the first and second cylinders lie on a plane that is substantially orthogonal with respect to the axis of rotation of the drive shaft.

* * * * *